US005426921A

United States Patent [19]

Beckmann

[11] Patent Number: 5,426,921

[45] Date of Patent: Jun. 27, 1995

[54] CARTON STACKING METHOD AND APPARATUS

[75] Inventor: Harald Beckmann, Gevelsberg, Germany

[73] Assignee: Maschinenfabrik Alfred Schmermund GmbH & Co., Gevelsberg, Germany

[21] Appl. No.: 40,879

[22] Filed: Mar. 31, 1993

[30] Foreign Application Priority Data

Apr. 1, 1992 [DE] Germany ..... 42 10 812.8

[51] Int. Cl.[6] ..... B65B 43/24

[52] U.S. Cl. ..... 53/566; 53/168; 53/253; 53/376.5; 53/540; 414/792; 414/793

[58] Field of Search ..... 414/792, 792.1, 793; 53/245, 253, 540, 579, 566, 567, 252, 168, 544, 251, 284, 376.5–377.2; 493/475, 476, 478

[56] References Cited

U.S. PATENT DOCUMENTS

| | | | |
|---|---|---|---|
| 665,241 | 1/1901 | Ludington | 53/253 X |
| 1,130,630 | 3/1915 | Remington | 53/253 X |
| 1,336,838 | 4/1920 | Heeter | 53/57 |
| 1,661,848 | 3/1928 | Plass | 53/566 |
| 3,137,981 | 6/1964 | Johnson et al. | 53/168 |
| 3,517,831 | 6/1970 | Hahn | 53/245 X |
| 3,533,333 | 10/1970 | McIntyre . | |
| 3,854,270 | 12/1974 | Cloud et al. | 53/253 X |
| 3,902,609 | 9/1975 | Ohlsson | 414/792 X |
| 4,026,422 | 5/1977 | Leenaards | 414/792 |
| 4,067,172 | 1/1978 | Paules | 53/53 |
| 4,258,526 | 3/1981 | Focke | 53/566 X |
| 4,554,777 | 11/1985 | Denk et al. | 53/201 |
| 4,566,836 | 1/1986 | Berger et al. | 414/793 X |
| 4,574,561 | 3/1986 | Dirico | 493/475 X |
| 4,633,655 | 1/1987 | Nigrelli | 53/284 X |
| 4,769,971 | 9/1988 | Martelli | 53/253 X |
| 4,823,539 | 4/1989 | Kuckhermann et al. | 53/579 |
| 4,850,782 | 7/1989 | Focke | 414/793 |
| 4,930,291 | 6/1990 | Boisseau | 53/168 X |
| 4,941,374 | 7/1990 | Focke | 414/793 X |
| 4,951,445 | 8/1990 | Thibault | 53/251 |
| 5,014,501 | 5/1991 | Constantin et al. | 53/253 X |
| 5,105,600 | 4/1992 | DePoint et al. | 53/168 X |
| 5,341,626 | 8/1994 | Beckmann | 53/566 |

FOREIGN PATENT DOCUMENTS

| | | | |
|---|---|---|---|
| 2493805 | 11/1980 | France . | |
| 2058949 | 12/1970 | Germany . | |
| 3018341 | 5/1980 | Germany . | |
| 3028151 | 7/1980 | Germany . | |
| 3110720 | 3/1981 | Germany . | |
| 3148569 | 12/1981 | Germany . | |
| 255138 | 12/1986 | Germany . | |
| 3825899 | 7/1988 | Germany . | |
| 2189209 | 10/1987 | United Kingdom | 414/792 |

*Primary Examiner*—Lowell A. Larson
*Assistant Examiner*—Daniel Moon
*Attorney, Agent, or Firm*—Chilton, Alix & Van Kirk

[57] ABSTRACT

During the packaging of articles in cartons, preparatory to shipment to consumers, the cartons are removed from filling/closing apparatus and stacked on pallets. The removal apparatus includes transporting the cartons singly to a stacking plane, orienting the cartons and then employing a robotic gripping device to move the oriented cartons to the proper stacking positions.

15 Claims, 5 Drawing Sheets

CARTON STACKING METHOD AND APPARATUS

BACKGROUND OF THE INVENTION

1. Field of the Invention

The present invention relates to the packaging of articles in sealed cartons and particularly to the stacking of cartons at the end of the packaging process. More specifically, this invention is directed to apparatus for manipulating cartons which may vary in format, including inserting articles to be packaged in erected carton blanks and thereafter closing the cartons, and especially to the stacking of cartonized articles on carriers. Accordingly, the general objects of the present invention are to provide novel and improved methods and apparatus of such character.

BRIEF DESCRIPTION OF THE PRIOR ART

While not limited thereto in its utility, the present invention is particularly well suited for use in the packaging of cigarettes. A given manufacturing facility may produce cigarettes which, when formed into packages, have several different configurations when considered from the viewpoint of package length, width and height. Such packages are formed into groups, for example for packaging and subsequent sale as multi-pack cartons, and the groups thus also have different dimensions. A packaging facility wherein the apparatus which forms the cartons is suitable for only a single format, or which can be changed to accommodate different carton formats only with considerable difficulty, is thus inefficient.

For an example of a prior art cartoning system, reference may be had to U.S. Pat. No. 3,478,487. The apparatus of this patent receives, as raw material, a carton blank which is in a flat configuration. This carton blank is first cut to the required size and then erected. During the erection operation, a side wall of the carton will be caused to move to an out-of-the-way position so that a stack of products to be packaged can be pushed into the carton interior through the open side wall area.

SUMMARY OF THE INVENTION

The present invention relates to a method of, and associated apparatus for, reliably and efficiently cartoning pre-formed groups of articles and for subsequently stacking the cartons. A particularly unique feature of the present invention is its ability to stack cartons having different formats.

Apparatus in accordance with a preferred embodiment of the invention, in the interest of maximizing operational speed, employs a stacking turret or turrets which may be automatically controlled. The stacking apparatus works in combination with a multi-cell carton filling and closing device having cells which are open-ended in the axial direction. The carton filling/closing device, and thus the open-ended cells, is caused to rotate, in step-wise fashion, about a horizontal axis. The erected carton blanks delivered into the cells of the filling/closing device are characterized by being closed in the side-wall region, i.e., the erected cartons are open only on the oppositely disposed ends. The carton-receiving cells are defined by cooperating adjacent pairs of movable and stationary walls such that the height and width dimensions of the cells may be readily changed. Means are associated with the filling/closing device to cause the application of an adhesive to the end flaps of the carton blank and to fold the end flaps to close the cartons after a group of articles have been inserted therein. The adhesive applicators and the end flap folding elements are also relatively adjustable to accommodate the carton blank format.

The present invention allows groups of articles having different formats to be cartoned utilizing a single apparatus and, accordingly, the cartoning apparatus may be used to its maximum capacity. The apparatus of the invention is characterized by simple, rapid and largely automatic adjustability to adapt to different carton formats and stacking requirements.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the two figures and in which.

DESCRIPTION OF THE DISCLOSED EMBODIMENT

Figure 1:
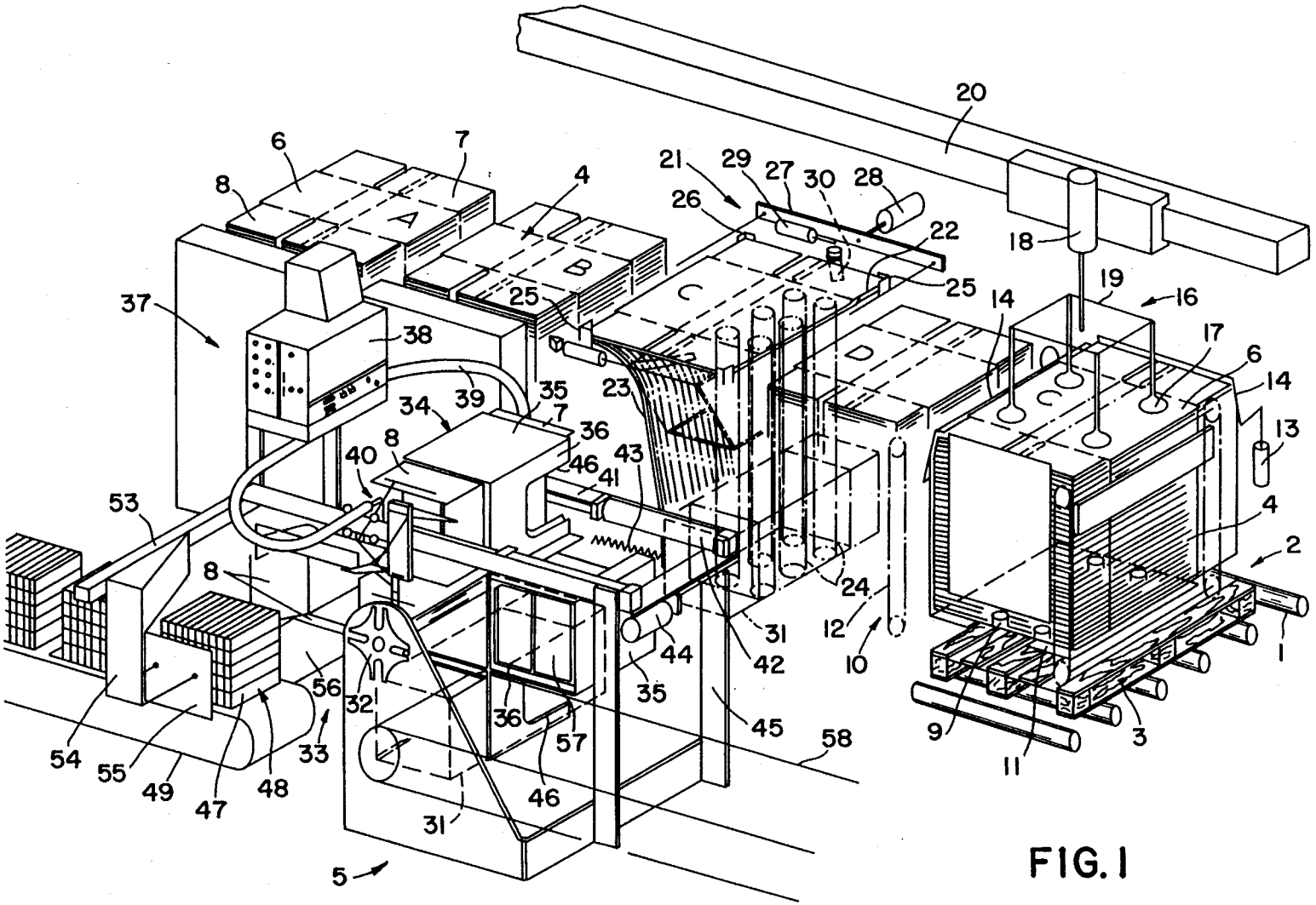
FIG. 1 is a schematic perspective view of a first embodiment of apparatus in accordance with the invention for erecting, filing and sealing cartons.
Figure 3:
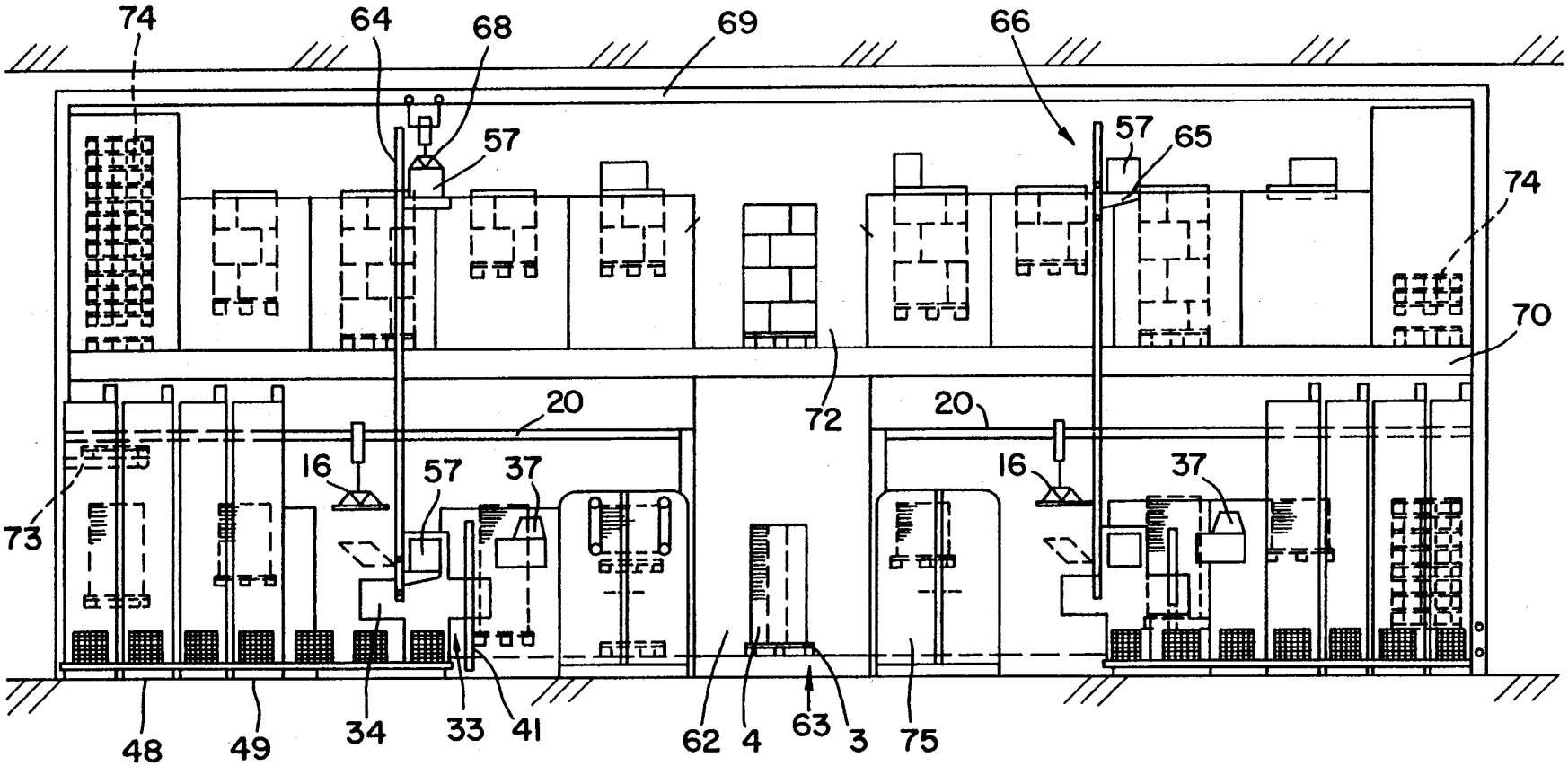
FIG. 3 is a schematic front elevational view of a cartoning installation having two of the cartoning apparatus of FIG. 1 and further having apparatus for causing stacked storage of completed cartons in accordance with the invention.
Figure 4:
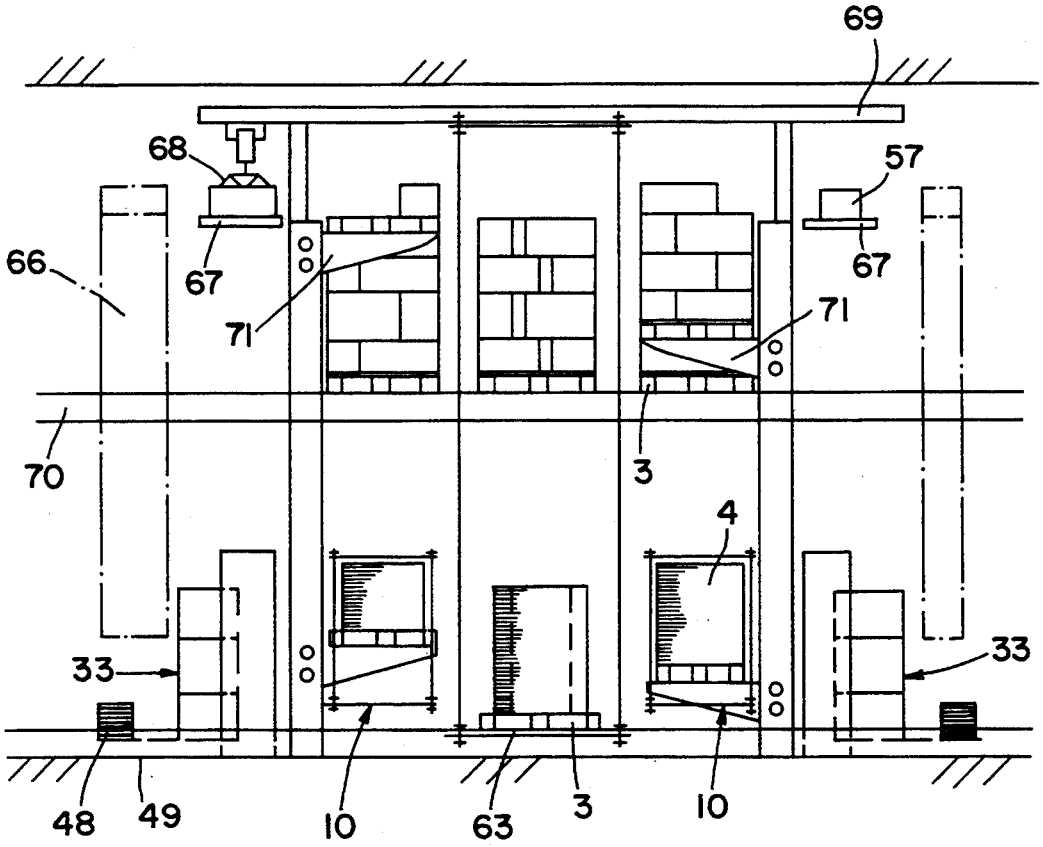
FIG. 4 is a side elevational view of the installation of FIG. 3.

In the practice of the present invention, particularly in the operation of the installation of FIGS. 3 and 4, the carton "blanks" 4 stacked on pallets 3 are received on a feed conveyor system 63. The blanks 4 will be of two-layer contruction, i.e., the blanks will be flattened cartons which will be erected, filled and closed in the manner to be described below. The stacks of carton blanks supported on pallets 3 are transferred from the feed conveyor 63 onto one of a plurality of parallelly arranged roller tables. Referring to FIG. 1, the roller tables 2 each include a plurality of rollers 1 and at least some of these rollers are drivable, by means which has not been shown, to move a pallet to a blank extraction position. Accordingly, the tables 2 will move the pallets 3 to a position where they are situated adjacent to the feed side of a multi-format cartoner, indicated generally at 5. The cartoner 5 includes an erection station 21 and a filling/closing station.

The two-layer blanks 4 from which the cartons are to be formed have a generally rectangular shape and are provided with fold lines and slots. The fold lines and slots define a carton side-wall forming region 6 and lid and bottom flap forming regions 7, 8 which extend outwardly from the side-wall region. The side-wall forming region 6 will have previously been partly coated with an adhesive and closed on itself so that it may be erected to form a flat-walled tube having a rectangular cross-section. Restated, the side-wall region 6 will include a joint whereby the two layers of the blank 4 are continuous in a first direction.

As the pallets 3 are delivered to the feed position for the erecting station, the blanks 4 are arranged with either the lid or the bottom flap forming regions facing the erection station 21. As the invention is depicted in FIG. 1, four stacks of carton blanks A, B, C and D, which may differ from stack-to-stack in respect of the printing on and/or the formats of the blanks 4, are positioned such that individual blanks can be withdrawn therefrom. The order of arrangement of the stacks A, B, C and D is not relevant to the practice of the invention. The pallets will, however, typically be arranged in accordance with the demand for the particular carton blanks 4 with the stack(s) of blanks having the highest consumption rate being located closest to the erection station.

Lifting rams 9 are provided beneath each of the roller tables 2. The rams 9, when activated, will raise a complete stack of carton blanks 4 from a pallet 3 such that the stack may be engaged by a lift, one of the lifts having been indicated generally at 10. The lift 10 engages the underside of the edge of the stack, or a partial stack, along two opposite sides by means of a pair of rail-like parallel supporting members 11 which have a wedge-shaped leading edge. The members 11 are vertically movable, via chain drives or toothed belts 12 which are connected thereto, in order to insure that the uppermost blank of the stack of blanks supported on members 11 will always be brought to the same level regardless of the number of carton blanks 4 which comprise the stack or are lifted from the stack on a pallet.

When all of the carton blanks 4 have been lifted from a pallet, i.e., when support for the entire stack of blanks or the last portion of a stack of blanks has been transferred to the lift 10, the rams 9 are retracted and the empty pallet 3 returned to conveyor 63 (FIG. 3) by reversing the transport direction of the table 2.

As a stack of blanks is raised, it will engage a pair of pivotal stops 14 and cooperating fixed stops 15, stops 14 being caused to pivot in the direction of the stack by means of fluidic actuators such as actuator 13. The pivotal stops 14 contact, in the disclosed embodiment, two adjacent edges of the stack while the oppositely disposed fixed stops 15 contact the two remaining edges of the stack. The pivotal stops 14 urge the carton blanks 4 which are located at the upper end of the stack against the fixed stops 15 as a result of the pivotal force provided by actuator 13. This inwardly directed force results in the carton blanks 4 at the top of the stack being properly positioned and being partially arched, i.e., the cartons at the top of the stack will be displaced relative to one another so that there is some separation between adjacent blanks and the blanks are thereby easier to grasp and extract from the top of the stack.

In order to individually remove carton blanks 4 from a stack supported by a lift 10, a gripping device indicated generally at 16 is provided. The gripping device 16 is movable along a horizontal rail 20 and includes an extracting head 19 which is provided with a plurality of suction devices 17. The extracting head 19 is vertically movable via a drive 18.

The gripping device 16 picks up the uppermost carton blank 4 from a stack and transfers that blank to erecting station 21. The erecting station 21 is provided with a pair of side walls 22 and 23. The walls 22 and 23 cooperate to define a shaft which narrows in the downward direction. To this end, in the disclosed embodiment, wall 22 is flat and vertical while wall 23 is oriented generally horizontally at its upper end and evolves, i.e., rotates about a corner region, into a downward extending wall which is obliquely oriented with respect to wall 22. At the bottom of the converging shaft defined by walls 22 and 23, the separation between the walls will be caused to correspond approximately to the width of the carton which is to be formed. Vacuum devices 24, which are vertically movable in the shaft defined by walls 22, 23, engage a single side wall defining area disposed within region 6 of a carton blank 4 and draw the blank downwardly into the shaft. Thus, through the combined action of the vacuum grippers 24 and the converging shaft defined by plates 22,23, a two layer carton blank 4 delivered to the top of the erecting device 21 is pulled downwardly and, as a result of the downward motion, folded to form an open-ended, cuboid shaped receiving space, i.e., a rectangular tube, which is open toward the lid and bottom flap forming regions 7, 8 of the blank 4.

A carton blank 4, as delivered to the erecting device 21, is substantially horizontally disposed and is supported by the vertically movable vacuum devices 24 and the horizontally oriented upper end portion of wall 23. In the interest of insuring that the blank will be properly positioned for folding in accordance with the preformed fold lines, locating devices in the form of angle members 25 are provided. Members 25 engage at least the two corners of the blank which are disposed closest to the downstream filling/closing station. In order to accommodate different format carton blanks, the location of the surface which supports the blanks prior to their being drawn downwardly can be varied by moving wall 23 relative to vertical wall 22. The wall 23 may, in fact, be slightly resiliantly biased toward wall 22 by means of a compression spring 43 whereby the width of the shaft of the erecting station 21 is to some degree self-adjusting. Additionally, or as an alternative, a pair of further corner locating angle members 26 may be employed. The spacing between members 25 and 26, when all four corners are to be contacted by locating members, will be variable by means of adjusting the position of a horizontally movable setting plate 27, plate 27 being coupled to an actuator 28.

The erecting station 21 is provided with pivotal support arms 30 which may be rotated inwardly, i.e., toward the center of a carton blank 4, by means of fluidic actuators 29. The support arms 30 prevent the bottom and lid flaps 7,8 of the carton blank from being bent downwardly when the blank is delivered to the erecting device. The support arms 30 and their actuators 29 are connected to the setting plate 27 and thus are adjustable as a function of the carton-blank length.

The carton blanks 4, as depicted in FIG. 1, are conventionally provided with slots between the lid flaps 7 and between the bottom flaps 8. The centrally located of the slots between the two lid flaps an between the two bottom flaps on a first layer of the two layer blank is offset relative to the slots in the other layer of the flattened carton blank. In the case of carton blanks which define an article receiving volumn having a cross-section which is other than square, which is the usual operating condition and is the situation illustrated in FIG. 1, it may be necessary or desirable to pivot the support arms 30 into the slots in the flap forming regions of the carton blanks so that only the upper layer of the blank 4 is supported in the flap regions. Accordingly, when pivoted into position under blank 4, the support arms 30 will contact only the upper layer of the blank. This mode of operation insures proper opening and reliably prevents the carton blank from kinking during the erecting operation.

Additionally, or as an alternative, the operation of the suction devices 17 of the extraction head 16 can be synchronized with the operation of vacuum devices 24 so as to delay release of the blank by devices 17 until after the downward motion of the vacuum devices 24 begins. This will result in the two layers of the carton blank being pulled apart at the beginning of the erecting operation. This delayed termination of the influence of extraction head 16 is particularly useful in the case of carton blanks which define content receiving areas having a square cross-section.

Although there are means other than the disclosed erecting station 21 which could be employed to erect a two layer carton blank, the above-described erecting device is particularly well suited for use in the practice of the present invention because of its exceptional ability to cooperate with the filling/closing apparatus in an uninterrupted feed cycle which includes movement of the carton blank in the vertical direction during erection.

A carton blank which has been erected in station 21 is indicated at 31. The transfer of this tubular, partially completed carton from the erecting station 21 to the filling/closing station is accomplished by means of a transfer device, not shown, which may be a reciprocal pusher plate. During this transfer the lower edge of the vertical wall 22 functions as a guide.

The carton filling/closing station is designed as a turret, indicated generally at 33, which is provided with a stepping drive 32. The turret 33 has a plurality of cells 34 which are open in the axial direction. In the disclosed embodiment, the turret employs four cells 34 which are offset relative to one other by 90°. The cells 34 of turret 33 each possess two adjacent stationary walls 35 and two adjacent movable walls 36, the movable walls 36 being individually displacable toward or away from oppositely disposed of the stationary walls 35. The movement of the cell walls, to adapt the receiving space of each cell to the cross-sectional format of the erected carton blank 31 which is to be received, is accomplishd by means of a servo-drive. The movable cell walls 36 may be spring biased in the inward direction, i.e., toward an oppositely situated fixed wall, and thus accommodate a small amount of play, i.e., approximately 2 to 3 mm, in order to compensate for variations in the dimensions of the cartons. This self-adjustment of the size of the cells 34 can, for example, be accomplished by designing the movable cell walls 36 as double walls with intermediate compression springs. It should also be noted that, in the embodiment of FIG. 1, the receiving position of a cell 34, i.e., the position where a cell 34 will be located when a carton is pushed therein from the erecting station 21, is the lowermost position as the turret rotates in stepwise fashion.

The filling/closing station also comprises an adhesive applicator, indicated generally at 37, which includes a heated reservoir 38. Hot glue is fed from reservior 38 to a pair of adhesive applicator heads 40 via feed conduits 39. The applicator heads 40 are movable along parallel rails 41. In the embodiment of FIG. 1, the rails 41 are arranged horizontally. Movement of the heads 40 is produced by means of an actuator 42. One of rails 41 will be stationary while the opposite rail is adjustable, by means of an actuator 44, to vary the spacing between the heads 40 as a function of the format of the carton being formed.

An oppositely disposed pair of the cell walls 35, 36 are provided with cutouts 46 which face in the direction of the movable rail 41. Because of the presence of the cutouts 46, the cell walls 35, 36 do not impede the adhesive application operation even when the length of the carton being formed is less than the axial length of the cells 34.

Figure 2:
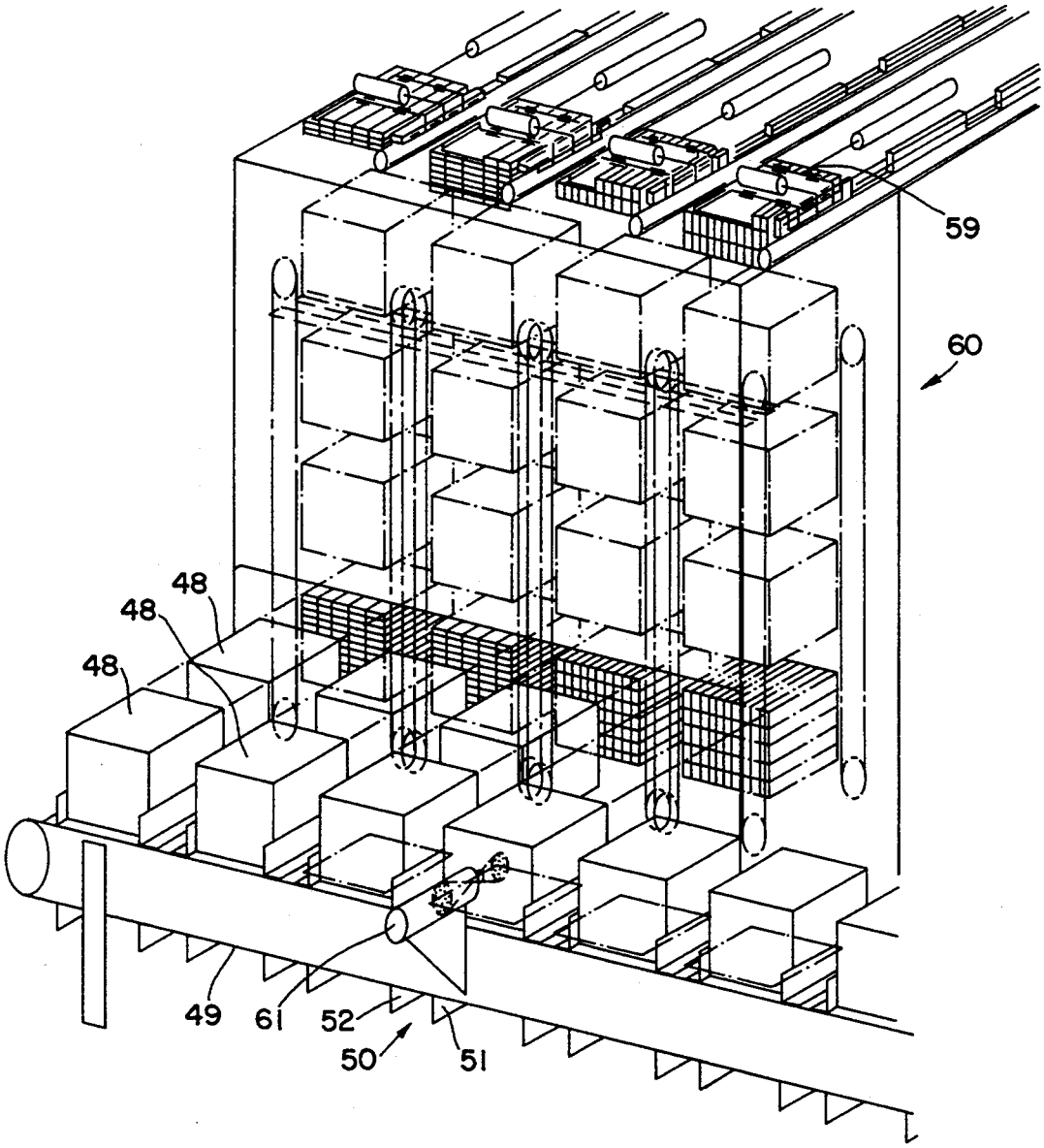
FIG. 2 is a schematic perspective view of apparatus for temporarily storing grouped articles which are to be cartoned, the groups having a plurality of different formats, and conveying the groups singly to the apparatus of FIG. 1.

Referring jointly to FIGS. 1 and 2, articles 47 to be packaged are delivered to the cartoner 5 by means of a conveyor which includes a belt 49. The articles travel on conveyor belt 49 as preformed groupings or bundles 48. The conveyor belt 49 is provided with separators, indicated generally at 50, in the form of upwardly extending partitions 51, 52. When a group of articles 48 located between a pair of separator partitions on the conveyor arrives at the delivery end of the conveyor, the stack will be in registration with a cell 34 of the turret 33. In the disclosed embodiment, the trailing end partitions 51 of the separators 50 of conveyor belt 49 are fixed in position. When a group of articles 48 being delivered on conveyor belt 49 moves into alignment with a cell 34 of turret 33, the fixed position partition 51 of the stack separators on the belt will be in alignment with a fixed wall of the cell 34 located at the receiving position. As will be obvious to those skilled in the art, the partitions 52 could be eliminated from the conveyor and, in such case, it would typically be desirable to align the group of articles 48 by urging it against partition 51 before the stack is transferred into a cell 34.

A slide arm 54, movable along a rail 53 which extends transversely relative to the longitudinal direction of conveyor belt 49, is positioned adjacent to the end of belt 49. A pusher plate 55 is mounted on the end of arm 54. Upon actuation of the slide arm 54, the plate 55 will push a group of articles 48 over a bridging plate 56 and into an erected carton blank 32 located within the cell 34 in the receiving position. The carton flaps, i.e., the lid or bottom flaps 7 and 8, which face in the direction of slide plate 55 may, if necessary or desirable, be at least partially deflected outwardly with respect to the interior of the carton by gripping devices, not shown, during the transfer operation in order to insure that the flaps do not impede the insertion of the stack 48 into the erected carton blank 32.

The slide plate 55 can be of adjustable size so that it may be matched to the size of the group of articles 48 which is to be pushed into an erected carton blank 32. Obviously, the minimum size and shape of slide plate 55 will be determined by the cross-section of the smallest erected carton blank 32 which is to be filled.

During rotation of turret 33, the cell 34 which contains an erected carton blank 32 filled with a group of articles 48 will, upstream of the adhesive applicator heads, move into engagement with folding elements which have not been shown in the drawing in the interest of facilitating understanding of the invention. Two of these folding elements are stationary relative to the rotating cell 34 and thus fold the inner bottom and lid flaps which are first encountered during rotation, i.e., the leading flaps. The direction of folding is, of course, toward the group of articles 48, and the folding thus proceeds in a direction opposite to the direction of turret rotation in the sense of the movement of the flap outer edges. A pair of further pivotal folding elements will engage the trailing bottom and lid flaps 7, 8 downstream of the adhesive applicator heads and fold these flaps down onto the previously folded, adhesively coated flaps. The folding elements which are located on the side of the turret where adjustable rail 41 is located will be adjustable, relative to oppositely disposed stationary folding elements, as a function of the format of the carton. The cut-outs 46 in the cell walls 35, 36 permit the folding elements to penetrate into the cells so as to completely fold the flaps of a short carton. Folding elements of the type being described are well known in the cigarette packaging art where they are employed in conjunction with indexable wrapping turrets which are employed in the formation of individual cigarette packages.

As noted above, after the folded-in inner bottom and lid flaps 7,8 have been coated with adhesive, i.e., during further indexing of turret 33 in the clockwise direction as the apparatus is depicted in FIG. 1, the outer bottom and lid flaps 7,8 are folded down onto the adhesive coated inner bottom and lid flaps. Accordingly, a completed carton 57 will be present in the cell 34 of turret 33 which reaches the discharge position, i.e., a position where the cell contents may be pushed out onto a further conveyor 58. The emptying of a completed carton 57 from a cell is accomplished by means of a slide mechanism, not shown.

Referring to FIG. 2, groups of articles 48 having a format which depends upon the particular product, for example the particular brand of cigarettes, may be stored in a multi-shaft collecting elevator which has been indicated generally at 60 in FIG. 2. The elevator 60 thus contains columns of product bundles or groups 48, these stacks being delivered to the columns of the elevator via slides 59 which are operated by fluidic actuators. The stacks are released from the elevator onto the conveyor belt 49 at spaced locations, i.e., are deposited between the separator partitions 51, 52. The physical characteristics of the groups of articles 48 which are to be cartoned can be detected via a reader 61, and the appropriate carton blank 4 will then be fed to the multi-format cartoner 5 at the appropriate time so that both the stack and erected carton blank will simultaneously arrive at the position where the stack is to be inserted into the erected carton.

It is possible that a condition may occur wherein the adhesive coating of the two-layer carton blanks 4 in the side-wall region 6 will result in an increase in carton blank thickness. Under such circumstances, in the interest of stability, it may be necessary to stack the carton blanks 4 on pallet 3 so that alternate blanks in the stack are rotated 180° relative to one another. Under such circumstances, the gripping device 16 which extracts the blanks from a stack on a pallet can be rotatable so that all of the blanks 4 will be fed to the erecting device 21 with the same orientation.

The tables 2 on which the pallets 3 are arranged in the FIG. 1 arrangement, need not be in a side-by-side orientation. For example, the pallets may be supported at least partly one above the other.

Referring now to FIGS. 3 and 4, in a particularly efficient implementation of the present invention, the groups or bundles 48 of articles to be cartoned are fed to a pair of multi-format cartoners of the type depicted in FIG. 1 from two opposite directions on timed conveyor belts 49. The carton filling/closing stations each include a turret 33, the turrets being arranged to either side of a middle aisle 62. A further conveyor, indicated generally at 63, extends along aisle 62 for the purpose of feeding pallets 3, which carry stacks of carton blanks 4, to the vicinity of erecting stations associated with each filling/closing station. The pallets 3 being delivered on conveyor 63 are displaced laterally, for example via roller tables 2 (see FIG. 1), into positions where they are engaged by lifts 10 (FIG. 1). In the manner described above, the carton blanks 4 which are required by the packaging facility will be extracted from the palletized stacks by means of extracting heads 16, fed to an erecting station 21 and the erected carton will subsequently be pushed into a cell 34 of a turret 33. In the installation of FIGS. 3 and 4, the erected carton, open at the opposite ends, will be pushed into the cells 34 which, as the turrets 33 rotate, are facing in the direction from which the groups of articles 48 are arriving. The article groups 48 are inserted into the erected cartons at the lowest positions of the cells and the adhesive is applied to the carton end flaps when the cell is in the position opposite to that where is receives the erected carton, i.e., when the cells are located closest to the middle of aisle 62. Thus, in the FIG. 3 installation, the adhesive applicators 40 are movable vertically.

The ejection of finished cartons 57 will take place at the uppermost position which will be occupied by a cell during the stepwise rotation of the turrets. The ejection of a finished carton 57 is accomplished by pushing the carton out of the cell onto a platform 65 of an elevator 66, the platform being movable along a vertical rail 64. The cartons 57 are subsequently pushed off platform 65 onto a turntable 67. The carton 57 is thereafter acquired by a gantry robot 68 which is movable within the bounds of a pallet storage area on rails 69. The pallet storage area is located on a stage 70 and comprises a series of pallet-lifting tables 71. The tables 71 support pallets 3 at a predetermined height so that the loading thereof with finished cartons 57 will always take place at the same level.

When the pallets 3 are filled with finished cartons 57, they are lowered to the stage height and subsequently conveyed at stage height to a middle aisle 72 which is located directly above the lower aisle 62. The pallets which have been emptied, for example pallets which are used to deliver the stacks of blanks to the erecting station, are transferred into a pallet stock 74 via a pallet lift 73. However, since substantially more pallets 3 are required for transporting finished cartons 57 than are used for supplying the carton blanks, stacks of pallets can be supplied to the stock 74 via conveyor 62. All of the above-described actions take place under the control of control electronics which are located in control cabinets 75.

It is also possible to accomplish the stacking of the finished cartons 57 by means of a palletizing robot. Thus, referring to FIG. 5, two or four of the pallet-lifting tables 71, which have a total capacity of four pallets 3, are incorporated in a dividing wall 76. Wall 76, which also encloses the drives for the lifting tables, is arranged with a further wall 77 to form a T-shaped structure. A turntable 67 is mounted centrally on wall 77, the drive for turntable 67 being enclosed within the wall. A carton 57 to be palletized is deposited on turntable 67. The carton support plane of turntable 67 is generally coplanar with the level to which the pallets 3 to be filled, or the uppermost of the layers of cartons 57 already located on a pallet 3, is raised by a lifting table 71. The walls 76, 77 may be employed as stops during the stacking of the cartons 57 but, as will be obvious to those skilled in the art, stacking can also be carried out without the use of these walls as stops.

A palletizing robot 78, which includes a vertical pivot axle 79 mounted in wall 76, includes a first pivot arm 80. Pivot arm 80 carries, at its free end, a vertically oriented further pivot axle 81 and the drive for a further pivot arm 82. The free end of arm 82 is provided with a vertically oriented axle 83 which functions as the rotary drive for a gripping head which has been indicated schematically at 84. The gripping head 84 is, in the disclosed embodiment, provided with suction ports 85. The length of the serially connected pivot arms 80, 82 will be such that the head 85 can reach all of the palletizing positions within the above-discussed planar loading level. The gripping head 84 will engage a carton 57 deposited on turntable 67 and will move that carton into an empty position in the uppermost carton layer on the pallets 3 which are to be filled with cartons 57.

Figure 5:
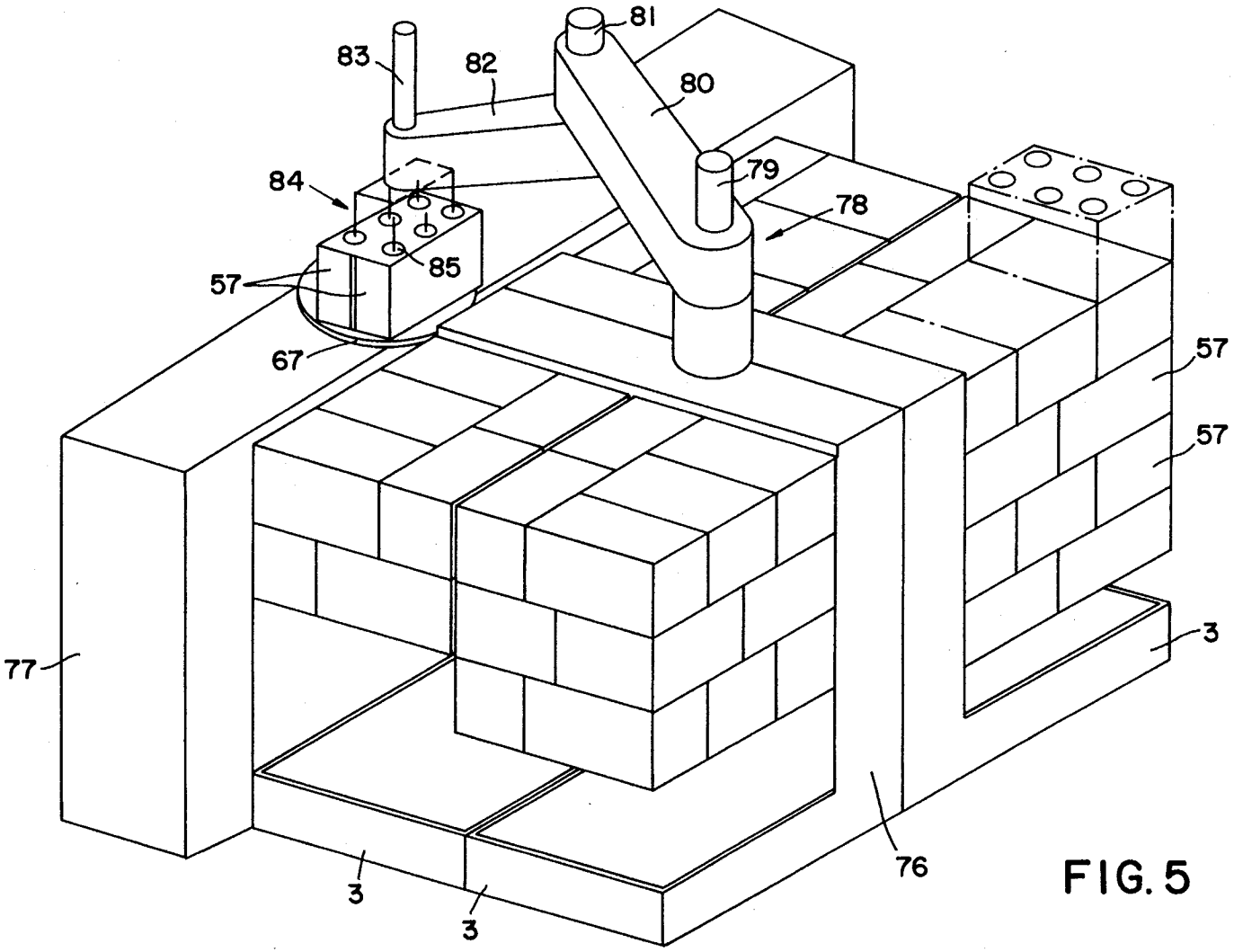
FIG. 5 is a schematic perspective view of a palletizing robot suitable for use in the installation of FIGS. 3 and 4.

The control for the apparatus of FIG. 5 may function to cause rotation of turntable 67 prior to engagement of a carton 57 by the gripping head 84 so that the carton will be in substantially the correct orientation when it is picked up from turntable 67. Thus, the carton 57 can be moved into the desired position as a result of the pivoting of only the arms 80, 82 or, if necessary, with an additional slight rotation of the gripping head 84 relative to arm 82. The apparatus of FIG. 5 is thus capable of operation in a highly efficient manner since significant vertical strokes of the gripping head 84 are unnecessary.

When turntable 67 is located higher than the plane of the last complete layer of cartons 57 on the pallets 3, a vertical stroke for the gripping head 84 along the axis of rotary axle 83 must, of course, be provided.

The walls 76, 77 can also be arranged in the manner of a cross, with the base of the palletizing robot 78 located at its center. Under such conditions, four pallets 3, arranged in the manner of a cloverleaf about the center, can be loaded simultaneously by the palletizing robot 78. In the arrangement being described, the turntable 67 will be arranged eccentrically. The distribution of the cartons 57 to the individual pallets 3 can be carried out by means of a suitable control which operates from information provided by reading indicia on the cartons 57.

In the interest of maximizing efficiency, space may be provided under each of the pallet-lifting tables for a reserve pallet.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. Apparatus for packaging stacks of articles within a package volume, said stacks having a generally rectangular cross-section and being supplied by a conveyor, the package being formed from a flattened carton blank having a continuous side-wall defining region and integral inner and outer bottom and lid flaps extending outwardly therefrom, the carton blanks having a format comprising a width and a length, said apparatus comprising:

at least two adjacent pallet stations, each of said pallet stations being configured to support a pallet carrying a stack of flattened carton blanks;

a rotary turret, said turret having a substantially horizontal rotation axis and at least four receiving cells, said cells defining axes which are parallel to said rotation axis and being open at a pair of axially displaced opposite ends;

means for causing said turret to rotate about said rotation axis, said rotation causing means producing step-wise motion of said turret whereby said cells are caused to advance from position to position along a continuous path;

means for erecting a flattened carton blank to a tubular configuration having the carton bottom and lid flaps extending outwardly in an axial direction at a pair of oppositely disposed open carton ends;

first griping means for gripping the uppermost blank of a stack of flattened carton blanks from a pallet supported at a selected of said pallet stations, said first gripping means being movable together with said gripped blank to transport said blank to said means for erecting flattened carton blanks;

means for inserting an erected carton blank in a cell of said turret at a first cell, the axial direction of the erected carton being coaxial with the cell axis;

means for transferring a stack of articles to be packaged into an erected carton blank disposed at a second position of said cell;

means for folding an inner bottom and a lid flap of an erected carton blank inwardly to a closed position during rotation of said cell to a third position;

means for applying adhesive to said inner folded bottom and lid flaps of an erected carton blank, said adhesive applying means being installed on both sides of said turret adjacent to the third position of said cell;

means for folding a remaining outer bottom and a remaining outer lid flap of a carton inwardly to contact the inner flaps to which adhesive is applied by said applying means during rotation of said cell to a fourth position whereby the package of stacked articles is completely assembled; and means for ejecting the completely assembled package from a cell at said fourth position and onto a conveyor.

2. The apparatus of claim 1 wherein said means for transferring articles into an erected carton blank includes conveyor means, said conveyor means being operated in synchronism with said turret such that a group of articles to be packaged and an erected carton blank will substantially simultaneously be brought into axial registration.

3. The apparatus of claim 1 wherein each of said cells has four walls defining a generally rectangular cross-sectional area, a pair of adjacent walls of each of said cells being fixed in position and a second pair of adjacent cell defining walls being adjustable relative to oppositely disposed of said fixed walls whereby the width and height of said cells may be self-varied to accommodate different carton blank formats.

4. The apparatus of claim 1 wherein said adhesive applying means is positioned at a distance from said flap folding means, said apparatus further comprising means for varying said distance between said flap folding and adhesive applying means as a function of the carton blank format.

5. The apparatus of claim 1 further comprising elevator means positioned adjacent to said turret for receiving cartons ejected therefrom subsequent to the complete assembly thereof, said elevator means being in horizontal registration with a cell of said turret at a third position thereof said third position being downstream of said second position and upstream of said first position in the direction of cell motion during turret rotation, said elevator means conveying filled cartons positioned thereon to a stacking plane displaced from the plane in which the cartons are received by said elevator means.

6. The apparatus of claim 5 further comprising:

pallet lifting means, said pallet lifting means receiving an empty pallet and raising said empty pallet to the level of said stacking plane whereby completed cartons conveyed by said elevator means may be deposited on said raised pallet.

7. The apparatus of claim 6 further comprising:

means associated with said pallet lifting means for transferring cartons from said elevator means to a pallet on said pallet lifting means, said transferring means positioning said carton at any desired location on the pallet to create a layer of cartons on the pallet.

8. The apparatus of claim 7 wherein said for means for transferring has a pair of interconnected arms which are pivotal in parallel horizontal planes, said pivoting motion including relative motion between said arms, said transferring means further having a carton gripping means supported from one of said arms adjacent the end thereof.

9. The apparatus of claim 8 wherein said carton gripping means includes a head having a plurality of suction ports in a first surface thereof, said first surface being arranged for contact with a side of a carton.

10. The apparatus of claim 9 wherein said carton gripping means head is movable in a direction transverse to the plane of movement of the arm on which said gripping means is mounted.

11. The apparatus of claim 8 wherein said means for transferring further comprises:

a turntable having a carton support surface, said turntable receiving cartons from said elevator means, said turntable being positioned such that said gripping means may be moved into registration therewith, said turntable orienting cartons prior to engagement thereof by said gripping means to thereby minimize the movements of said arms.

12. In apparatus for packaging articles within a package volume having a generally rectangular cross-section, the package being formed from a flattened carton blank having a continuous side-wall defining region and integral bottom and lid flaps extending outwardly therefrom each of the carton blanks having a format comprising a width and a length, the improvement comprising:

a plurality of adjacent pallet stations, each of said pallet stations supporting a pallet carrying a stack of flattened carton blanks;

a rotary turret, said turret having a plurality of receiving cells, each of said receiving cells having four walls defining a generally rectangular cross-sectional area and being open at a pair of opposite ends, a pair of adjacent walls of each of said cells being fixed in position and a second pair of adjacent cell defining walls being adjustable relative to oppositely disposed of said fixed walls whereby the width and height of said cells may be varied to accommodate different carton blank formats;

means for causing said turret to rotate about an axis, said rotation causing means producing step-wise motion of said turret;

means for erecting a flattened carton blank to a tubular configuration having the carton bottom and lid flaps extending outwardly at a pair of oppositely disposed open carton ends;

flattened carton blank from a selected of said pallet stations to said means for erecting flattened carton blanks;

means for inserting an erected carton blank in a cell of said turret at a first position of said turret, the open ends of the erected carton being in registration with the open ends of the cell;

means for transferring articles to be packaged into an erected carton blank disposed in a cell of said turret;

means for folding at least a first bottom and a first lid flap of an erected carton blank inwardly to a closed position during rotation of said turret;

means for applying adhesive to at least said first bottom and lid flaps of an erected carton blank, said adhesive applying means being located at a second position of said turret;

means for folding a remaining bottom and a remaining lid flap of a carton inwardly to contact the flaps to which adhesive is applied whereby the cartons are completely assembled, said means for folding being positioned at a distance from said adhesive applying means;

means for varying the spacing between said flap folding and adhesive applying means to accommodate each of said different carton blank formats;

means for stacking completed cartons, said stacking means including a first arm having a first end mounted for pivotal motion about a fixed axis and a second arm mounted to the second end of said first arm for pivotal motion about an axis, said arms being movable in parallel planes;

carton gripping means mounted from the second end of said second arm;

a turntable, said turntable being positioned within the range of movement of said gripping means, said turntable orienting cartons deposited thereon for subsequent engagement by said gripping means; and means for delivering cartons from said turret to said turntable, said delivering means being justapositioned to said turret at a location downstream of said second position and upstream of said first position in the direction of cell movement during rotation of said turret.

13. The apparatus of claim 12 wherein said gripping means includes a gripping head having a plurality of suction ports.

14. The apparatus of claim 13 wherein said gripping head is movable relative to said second pivot arm in a direction transverse to the plane of motion of said second pivot arm.

15. The apparatus of claim 12 wherein said fixed axis is defined by a pivot shaft mounted in a first wall and wherein said apparatus further comprises:

at least a pair of pallet lift means, said pallet lift means being positioned at opposite sides of said first wall.

* * * * *

UNITED STATES PATENT AND TRADEMARK OFFICE

CERTIFICATE OF CORRECTION

PATENT NO. : 5,426,921

DATED : June 27, 1995

INVENTOR(S) : Harald Beckmann

It is certified that error appears in the above-indentified patent and that said Letters Patent is hereby corrected as shown below:

Column 2, line 21, "filing" should be --filling--.

Column 4, line 57, "an" should be --and--.

Column 10, line 19, after "first" insert --position of said--.

Column 12, line 8, before "flattened" insert --means for transferring a--.

Signed and Sealed this

Fifth Day of November, 1996

*Attest:*

*Attesting Officer*

BRUCE LEHMAN

*Commissioner of Patents and Trademarks*